US005896987A

United States Patent [19]

Bettenhausen

[11] Patent Number: 5,896,987

[45] Date of Patent: Apr. 27, 1999

[54] INSTRUMENT CASSETTE HAVING STACKING FEATURE

[75] Inventor: Cary A. Bettenhausen, Indianopolis, Ind.

[73] Assignee: Sterilization Cassette Systems, Inc., Greenwood, Ind.

[21] Appl. No.: 09/040,122

[22] Filed: Mar. 17, 1998

[51] Int. Cl.[6] ..... B65D 83/10

[52] U.S. Cl. ..... 206/370; 206/438; 206/511

[58] Field of Search ..... 206/363–370, 206/438, 508, 503, 509, 511; 220/4.27; 422/104, 297, 300, 310

[56] References Cited

U.S. PATENT DOCUMENTS

| | | | |
|---|---|---|---|
| 4,373,633 | 2/1983 | Lutz, Sr. | 206/511 |
| 4,428,145 | 1/1984 | Wheeler | 220/4.27 |
| 4,505,506 | 3/1985 | Picozza | 206/503 |
| 4,643,303 | 2/1987 | Arp et al. | 206/370 |
| 4,661,326 | 4/1987 | Schainholz . | |
| 5,125,511 | 6/1992 | Chamberlin et al. . | |
| 5,284,632 | 2/1994 | Kudla et al. . | |
| 5,303,824 | 4/1994 | Kohn | 206/503 |
| 5,384,103 | 1/1995 | Miller . | |
| 5,415,846 | 5/1995 | Berry, Jr. . | |
| 5,482,067 | 1/1996 | Wittrock et al. | 206/363 |
| 5,540,901 | 7/1996 | Riley . | |

*Primary Examiner*—Paul T. Sewell
*Assistant Examiner*—Luan K. Bui
*Attorney, Agent, or Firm*—Maginot, Addison & Moore

[57] ABSTRACT

An instrument cassette includes a first container portion having a first plate which defines a first substantially planar interior surface, wherein the first planar interior surface defines an interior surface line $L_1$. The instrument cassette also includes a second container portion having a second plate which defines a second substantially planar interior surface, wherein (i) the second planar interior surface defines an interior surface line $L_2$, and (ii) the second container portion is positioned relative to the first container portion so that an interior space is defined therebetween. The instrument cassette further includes a positioning member formed in the first plate, wherein (i) the positioning member includes a first positioning segment which extends immediately outwardly from the first planar interior surface in a direction away from the interior surface line $L_1$, (ii) the positioning member further includes a second positioning segment which extends inwardly from the first positioning segment in a direction toward the interior surface line $L_1$, and (iii) no portion of the first positioning segment or the second positioning segment extends into the interior space across the interior surface line $L_1$. The instrument cassette also includes a locating member formed in the second plate, wherein (i) the locating member includes a first locating segment which extends immediately outwardly from the second planar interior surface in a direction away from the interior surface line $L_2$, (ii) the locating member further includes a second locating segment which extends from the first locating segment, and (iii) no portion of the first locating segment or the second locating segment extends into the interior space across the interior surface line $L_2$. An associated instrument cassette assembly is also disclosed.

6 Claims, 5 Drawing Sheets

INSTRUMENT CASSETTE HAVING STACKING FEATURE

BACKGROUND OF THE INVENTION

The present invention relates generally to an instrument cassette, and more particularly, to an instrument cassette that is equipped with a stacking feature having physical dimensions which do not compromise functionality of the instrument cassette.

An instrument cassette is a container in which medical or dental instruments may be retained during a cleaning process and subsequent storage of the instruments. During cleaning, sterilization and subsequent storage, it is sometimes desirable to stack one instrument cassette on top of another instrument cassette for purposes of space conservation.

To facilitate stacking, certain instrument cassettes have been designed with stacking features. One example of an instrument cassette that includes a stacking feature is U.S. Pat. No. 5,384,103 which is issued to Miller. The Miller reference discloses an instrument tray which includes a base and cover. The cover has a circular aperture positioned at each corner of its rectangular top surface. The base includes a rectangular floor having four foot members affixed thereto. Each foot member is affixed to a corner of the rectangular floor. In use, the foot members of one instrument tray are positioned to extend through the corresponding apertures of an adjacent instrument tray thereby inhibiting sliding of adjacent trays relative to each other.

In addition, it is not uncommon for containers outside of the instrument cassette art to be provided with stacking features. For example, U.S. Pat. No. 5,125,511 issued to Chamberlin et al. discloses a blow molded box which is used for containing videocassettes therein. In particular, the blow molded box includes a base having a first stacking structure. The box further includes a cover having a second stacking structure which cooperates with the first stacking structure so as to inhibit relative movement between adjacent boxes.

While the above described designs do adequately inhibit adjacent containers from moving relative to one another, these designs possess certain drawbacks. For example, in the Miller reference, when an upper instrument tray is stacked on top of a lower instrument tray, all of the foot members which are attached to the upper instrument tray extend into the container space of the lower instrument tray thereby consuming some of the limited container space of the lower instrument tray. In addition, the foot members described in the Miller reference are configured to have sharp edges and protrude from the instrument tray such that they are likely to tear or punch a hole through a wrap positioned around the instrument tray. This is another drawback since wraps are commonly positioned around instrument trays to protect the instruments contained therein from contamination once they have been sterilized, and tearing or punching a hole through the wrap compromises this protection. Specifically, creating a hole or tear in the wrap allows contaminating substances (e.g. dust or dirt) to pass through the hole or tear and come into contact with the instruments contained within the instrument tray.

Moreover, the first and second stacking structures of the blow molded box described in the Chamberlin reference extend into the interior of the box thereby consuming valuable container space. Additionally, when two blow molded boxes which incorporate Chamberlin's design are stack one on top of the other, the gap defined between the upper box and the adjacent lower box would be extremely narrow. More specifically, the first stacking structure of the lower box and the second stacking structure of the upper box are configured so that only an extremely small distance would separate the top surface of the cover of the lower box from the bottom surface of the base of the upper box. Thus, it would not be desirable to incorporate Chamberlin's design into an instrument cassette since facilitating air flow between adjacent instrument cassettes is an important consideration during an instrument cleaning process such as sterilization with an autoclave machine.

What is needed therefore is an instrument cassette that is equipped with a stacking feature which has physical dimensions which do not compromise functionality of the instrument cassette.

SUMMARY OF THE INVENTION

In accordance with one embodiment of the present invention, there is provided an instrument cassette. The instrument cassette includes a first container portion having a first plate which defines a first substantially planar interior surface, wherein the first planar interior surface defines an interior surface line $L_1$. The instrument cassette also includes a second container portion having a second plate which defines a second substantially planar interior surface, wherein (i) the second planar interior surface defines an interior surface line $L_2$, and (ii) the second container portion is positioned relative to the first container portion so that an interior space is defined therebetween. The instrument cassette further includes a positioning member formed in the first plate, wherein (i) the positioning member includes a first positioning segment which extends immediately outwardly from the first planar interior surface in a direction away from the interior surface line $L_1$, (ii) the positioning member further includes a second positioning segment which extends inwardly from the first positioning segment in a direction toward the interior surface line $L_1$, and (iii) no portion of the first positioning segment or the second positioning segment extends into the interior space across the interior surface line $L_1$. The instrument cassette also includes a locating member formed in the second plate, wherein (i) the locating member includes a first locating segment which extends immediately outwardly from the second planar interior surface in a direction away from the interior surface line $L_2$, (ii) the locating member further includes a second locating segment which extends from the first locating segment, and (iii) no portion of the first locating segment or the second locating segment extends into the interior space across the interior surface line $L_2$.

Pursuant to another embodiment of the invention, there is provided an instrument cassette. The instrument cassette includes a lid having a cover plate which defines a first substantially planar interior surface, wherein the first planar interior surface defines an interior surface line $L_1$. The instrument cassette also includes a receptacle having a floor plate which defines a second substantially planar interior surface, wherein (i) the second planar interior surface defines an interior surface line $L_2$, and (ii) the receptacle is positioned relative to the lid so that an interior space is defined therebetween. The instrument cassette further includes a positioning member formed in the cover plate, wherein (i) the positioning member includes a first positioning segment which extends immediately outwardly from the first planar interior surface in a direction away from the interior surface line $L_1$, (ii) the positioning member further includes a second positioning segment which extends inwardly from the first positioning segment in a direction toward the interior surface line $L_1$, and (iii) no portion of the first positioning segment or the second positioning segment extends into the interior space across the interior surface line $L_1$. The instrument cassette also includes a locating member formed in the floor plate, wherein (i) the locating member includes a first locating segment which extends immediately outwardly from the second planar interior surface in a direction away from the interior surface line $L_2$, (ii) the locating member further includes a second locating segment which extends from the first locating segment, and (iii) no portion of the first locating segment or the second locating segment extends into the interior space across the interior surface line $L_2$.

In accordance with yet another embodiment of the invention, there is provided an instrument cassette assembly. The instrument cassette assembly includes a first instrument cassette having (i) a first interior space and (ii) a lid having a cover plate which defines a first substantially planar interior surface, wherein the first planar interior surface defines an interior surface line $L_1$. The instrument cassette assembly also includes a positioning member formed in the cover plate, wherein (i) the positioning member has a first positioning segment which extends immediately outwardly from the first planar interior surface in a direction away from the interior surface line $L_1$, (ii) the positioning member also has a second positioning segment which extends inwardly from the first positioning segment in a direction toward the interior surface line $L_1$, (iii) the positioning member further has a third positioning segment which extends from the second positioning segment, (iv) the first positioning segment, the second positioning segment, and the third positioning segment collectively define a pocket, and (v) no portion of the pocket extends into the interior space across the interior surface line $L_1$. The instrument cassette assembly further includes a second instrument cassette having (i) a second interior space and (ii) a receptacle having a floor plate which defines a second substantially planar interior surface, wherein the second planar interior surface defines an interior surface line $L_3$. The instrument cassette assembly also includes a locating member formed in the floor plate of the second instrument cassette, wherein (i) the locating member has a first locating segment which extends immediately outwardly from the second planar interior surface in a direction away from the interior surface line $L_3$, (ii) the locating member also has a second locating segment which extends from the first locating segment, (iii) the first locating segment and the second locating segment collectively define a cassette leg, (iv) no portion of the cassette leg extends into the second interior space across the interior surface line $L_3$, (v) the second instrument cassette is stacked on top of the first instrument cassette such that (A) the cassette leg is positioned within the pocket and (B) an air flow gap is defined between the cover plate and the floor plate, and (vi) no portion of the cassette leg extends into the first interior space across the interior surface line $L_1$.

It is therefore an object of the present invention to provide a new and useful instrument cassette.

It is also an object of present invention to provide an improved instrument cassette.

It is yet another object of present invention to provide an instrument cassette that is equipped with a stacking feature which is configured not to consume the container space of the instrument cassette.

It is also an object of present invention to provide an instrument cassette that is equipped with a stacking feature which is configured so as not to create an obstacle which could interfere with placement of instruments within the instrument cassette.

It is still another object of the present invention to provide an instrument cassette that is equipped with a stacking feature which is configured to so that a relative wide air flow gap is created between adjacent instrument cassettes when the instrument cassettes are stacked one on top of the other.

The above and other objects, features, and advantages of the present invention will become apparent from the following description and the attached drawings.

DETAILED DESCRIPTION OF THE INVENTION

Figure 1:
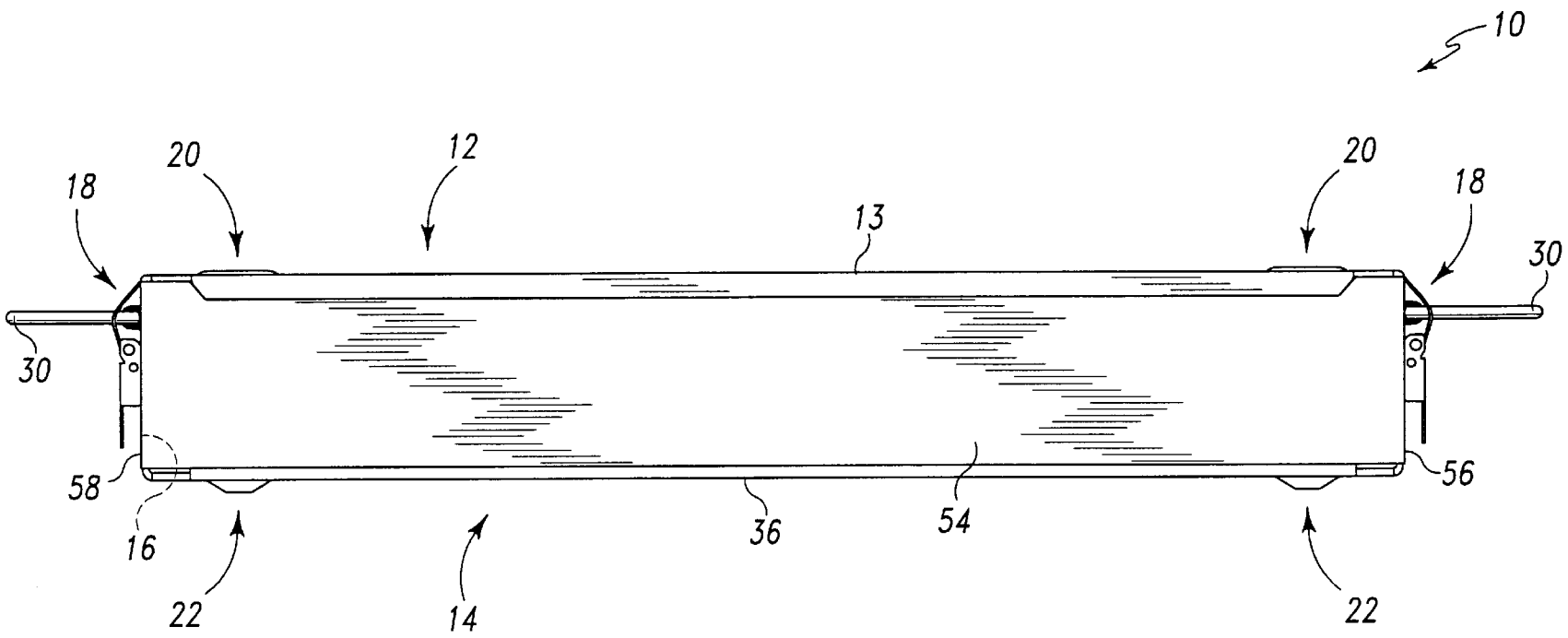
FIG. 1 is a side elevational view of an instrument cassette which incorporates the features of the present invention therein.

While the invention is susceptible to various modifications and alternative forms, a specific embodiment thereof has been demonstrated by way of example in the drawings and will herein be described in detail. It should be understood that there is no intent to limit the invention to the particular form disclosed, but on the contrary, the intention is to cover all modifications, equivalents, and alternatives falling within the spirit and scope of the invention as defined by the appended claims.

Figure 2:
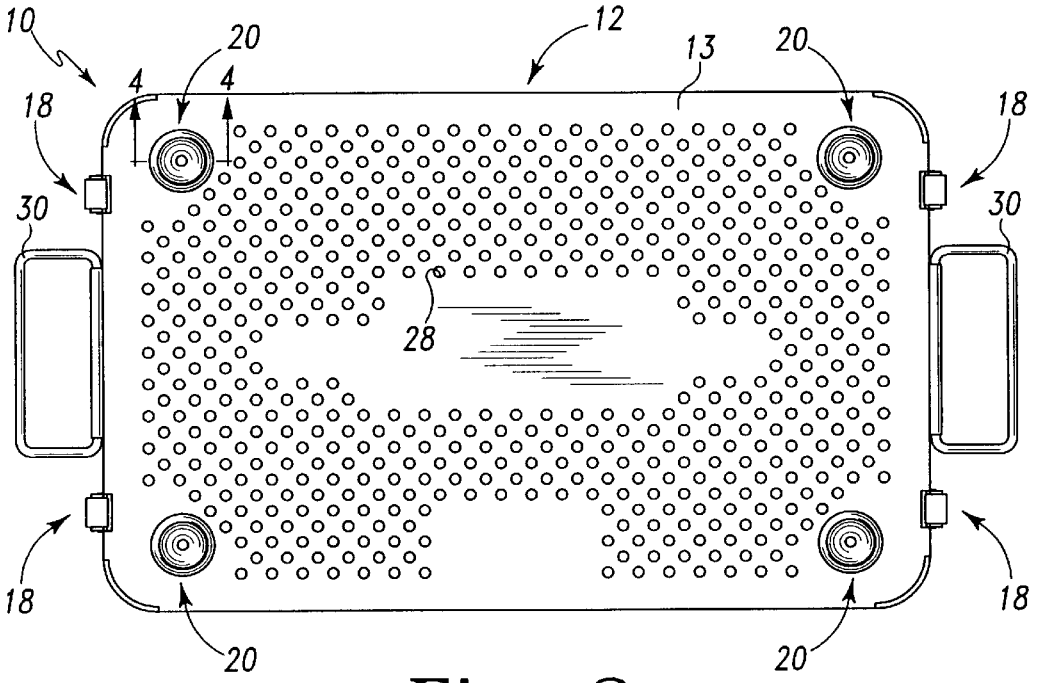
FIG. 2 is a top elevational view of the instrument cassette of FIG. 1 showing a number of positioning members defined therein.
Figure 3:
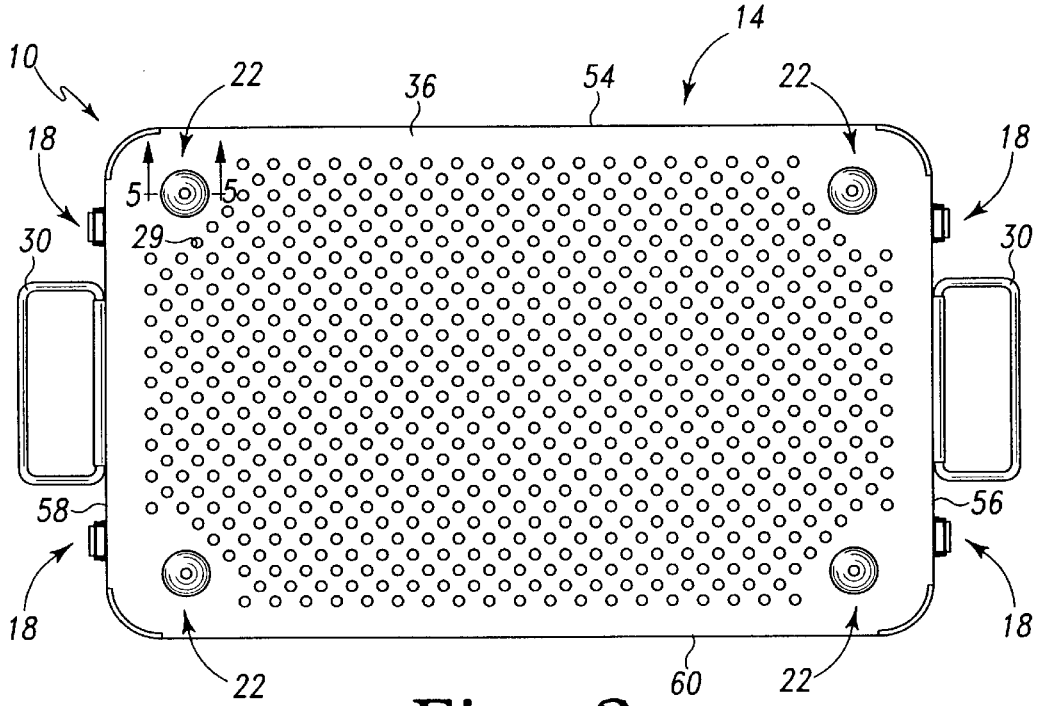
FIG. 3 is a bottom elevational view of the instrument cassette of FIG. 1 showing a number of locating members defined therein.

Referring now to FIGS. 1–3, there is shown an instrument cassette 10 which incorporates the features of the present invention therein. The instrument cassette 10 is used to hold medical or dental instruments (hereinafter "instruments"; not shown) and permits cleaning, sterilization, and storage of such instruments while housed in the instrument cassette 10. Instrument cassette 10 includes a container portion 12 and a container portion 14. Container portion 12 includes a plate 13 having a number of positioning members 20 formed therein. Plate 13 also has a number of holes 28 defined therein. Holes 28 are configured to allow fluid, such as a sterilizing gas, to flow therethrough.

Container portion 14 includes a plate 36 having a number of locating members 22 formed therein. Plate 36 also has a number of holes 29 defined therein. Holes 29 are also configured to allow fluid, such as a sterilizing gas, to flow therethrough. Container portion 14 further includes four side walls attached in a substantially perpendicular fashion to the periphery of plate 36. In particular, as shown in FIGS. 1 and 3, a sidewall 54 is attached to a front edge of plate 36, whereas a side wall 60 is attached to a back edge of plate 36. In addition, a side wall 56 is attached to a right edge of plate 36, whereas a side wall 58 is attached to a left edge of plate 36. Collectively, side walls 54, 56, 58 and 60 cooperate with plate 36 so as to provide a tray-like structure. Moreover, a pair of handles 30 is provided. The handles 30 are respectively secured to side walls 56 and 58.

Container portion 12 is positioned relative to container portion 14 such that container portion 12 rests on side walls 54, 56, 58, and 60. Furthermore, container portion 12 is positioned relative to container portion 14 such that plate 13 is spaced apart from plate 36 so that an interior space 16 (see FIG. 1) is defined therebetween. A number of latch mechanisms 18 are attached to instrument cassette 10 so as to secure container portion 12 to container portion 14 in the above described orientation.

Figure 4:
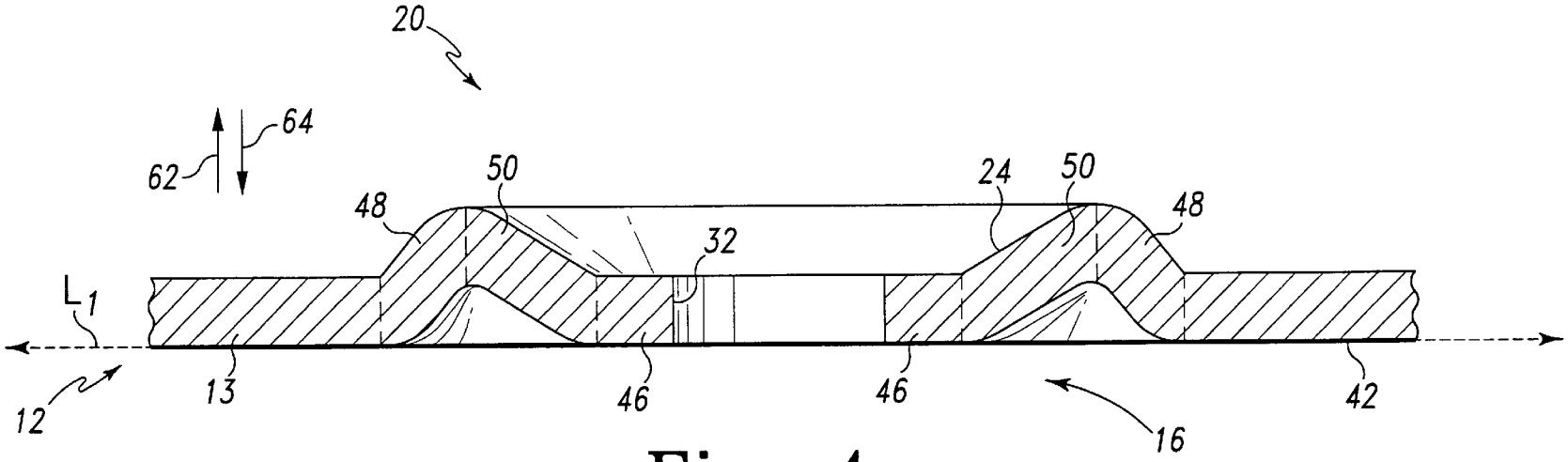
FIG. 4 is an enlarged cross sectional view of a positioning member taken along the line 4—4 of FIG. 2 as viewed in the direction of the arrows.

As shown in FIG. 4, plate 13 defines a substantially planar interior surface 42. Substantially planar interior surface 42 defines an interior surface line $L_1$. Positioning member 20 includes a positioning segment 48 which extends immediately outwardly from substantially planar interior surface 42 in a direction away from interior surface line $L_1$ (i.e. in a direction indicated by arrow 62). Positioning member 20 also includes a positioning segment 50 which extends inwardly from positioning segment 48 in a direction toward interior surface line $L_1$ (i.e. in a direction indicated by arrow 64). Positioning member 20 further includes a positioning segment 46 which (i) has a drainage hole 32 defined therein and (ii) extends from positioning segment 50. Positioning segment 48, positioning segment 50, and positioning segment 46 collectively define a pocket 24. It should be understood that any liquid entering pocket 24 may exit through drainage hole 32. Allowing liquid to exit through drainage hole 32 prevents liquid from pooling in pocket 24 which is undesirable during cleaning and/or sterilization of instruments contained within instrument cassette 10.

It should be understood that the positioning member 20 is configured such that no portion of positioning segment 46, positioning segment 48, positioning segment 50, and pocket 24 extends into interior space 16 across interior surface line $L_1$. In other words, no portion of positioning member 20 extends into interior space 16 across interior surface line $L_1$. Since no portion of positioning member 20 extends into interior space 16 across interior surface line $L_1$, the positioning member 20 does not consume the limited container space of the instrument cassette 10 which is otherwise used for storing instruments. In addition, since no portion of positioning member 20 extends into interior space 16 across interior surface line $L_1$, the positioning member 20 does not create an obstacle which could interfere with placement of instruments within the instrument cassette 10.

Furthermore, it should be understood that the above described configuration of positioning member 20 does not have any sharp edges or pointed structures which can punch through or tear a wrap (not shown; e.g. a paper wrap) positioned around instrument cassette 10. This is an important aspect of the present invention since wraps are commonly positioned around instrument cassette 10 to protect the instruments contained therein from contamination once they have been sterilized, and tearing or punching a hole through the wrap compromises this protection. Specifically, creating a hole or tear in the wrap allows contaminating substances (e.g. dust or dirt) to pass through the hole or tear and come into contact with the instruments contained within the instrument cassette 10.

Figure 5:
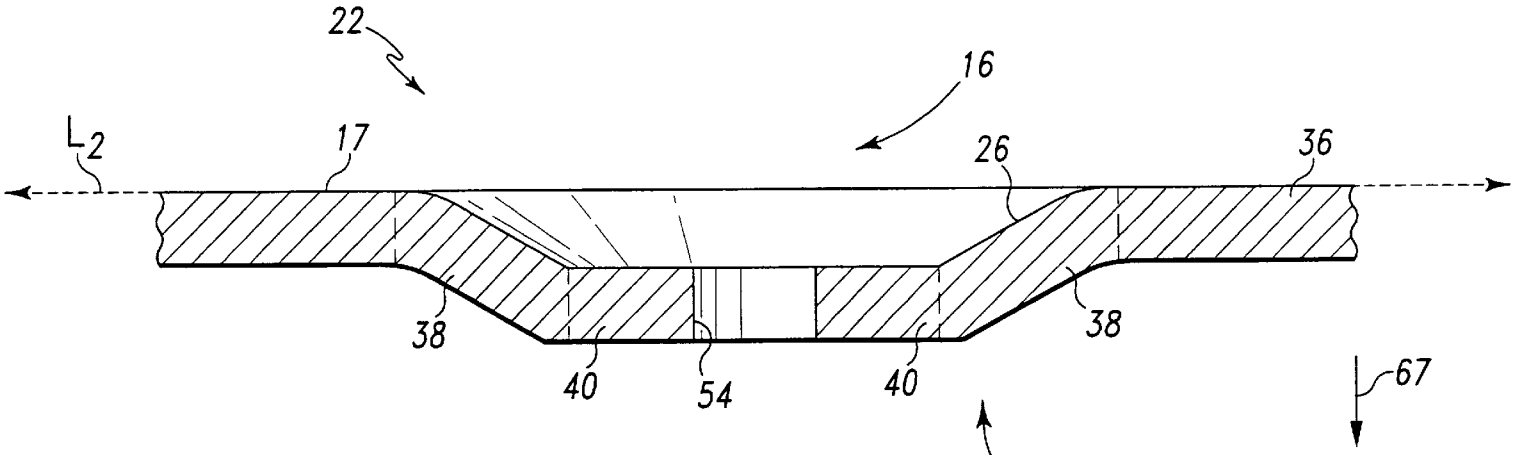
FIG. 5 is an enlarged cross sectional view of a locating member taken along the line 5—5 of FIG. 3 as viewed in the direction of the arrows (note that FIG. 5 has been rotated 180° such that the locating member extends in a downward direction rather than an upward direction for clarity of description)

Referring now to FIG. 5, plate 36 defines a substantially planar interior surface 17. Substantially planar interior surface 17 defines an interior surface line $L_2$. Locating member 22 includes a locating segment 38 which extends immediately outwardly from planar interior surface 17 in a direction away from interior surface line $L_2$ (i.e. in a direction indicated by arrow 67). Locating member 22 also includes a locating segment 40 which (i) has a drainage hole 54 defined therein and (ii) extends from locating segment 38. Locating segment 38 and locating segment 40 collectively define a cassette leg 44 having a recess 26 defined therein. It should be understood that any liquid entering recess 26 may exit through drainage hole 54. Allowing liquid to exit through drainage hole 54 prevents liquid from pooling in recess 26 which is undesirable during cleaning and/or sterilization of instruments contained within instrument cassette 10.

It should be understood that locating member 22 is configured such that no portion of locating segment 38 or locating segment 40 extends into interior space 16 across interior surface line $L_2$. In other words, no portion of cassette leg 44 extends into interior space 16 across interior surface line $L_2$. Since no portion of cassette leg 44 extends into interior space 16 across interior surface line $L_2$, the cassette leg 44 does not consume the limited container space of the instrument cassette 10 which is otherwise used for storing instruments. In addition, since no portion of cassette leg 44 extends into interior space 16 across interior surface line $L_1$, the cassette leg 44 does not create an obstacle which could interfere with placement of instruments within the instrument cassette 10.

Moreover, it should be understood that the above described configuration of locating member 22 does not have any sharp edges or pointed structures which can punch through or tear a wrap (not shown; e.g. a paper wrap) positioned around instrument cassette 10. This is another important aspect of the present invention since, as described above, wraps are commonly positioned around instrument cassette 10 to protect the instruments contained therein from contamination once they have been sterilized, and tearing or punching a hole through the wrap compromises this protection in the same manner as described above in reference to positioning member 20.

Figure 6:
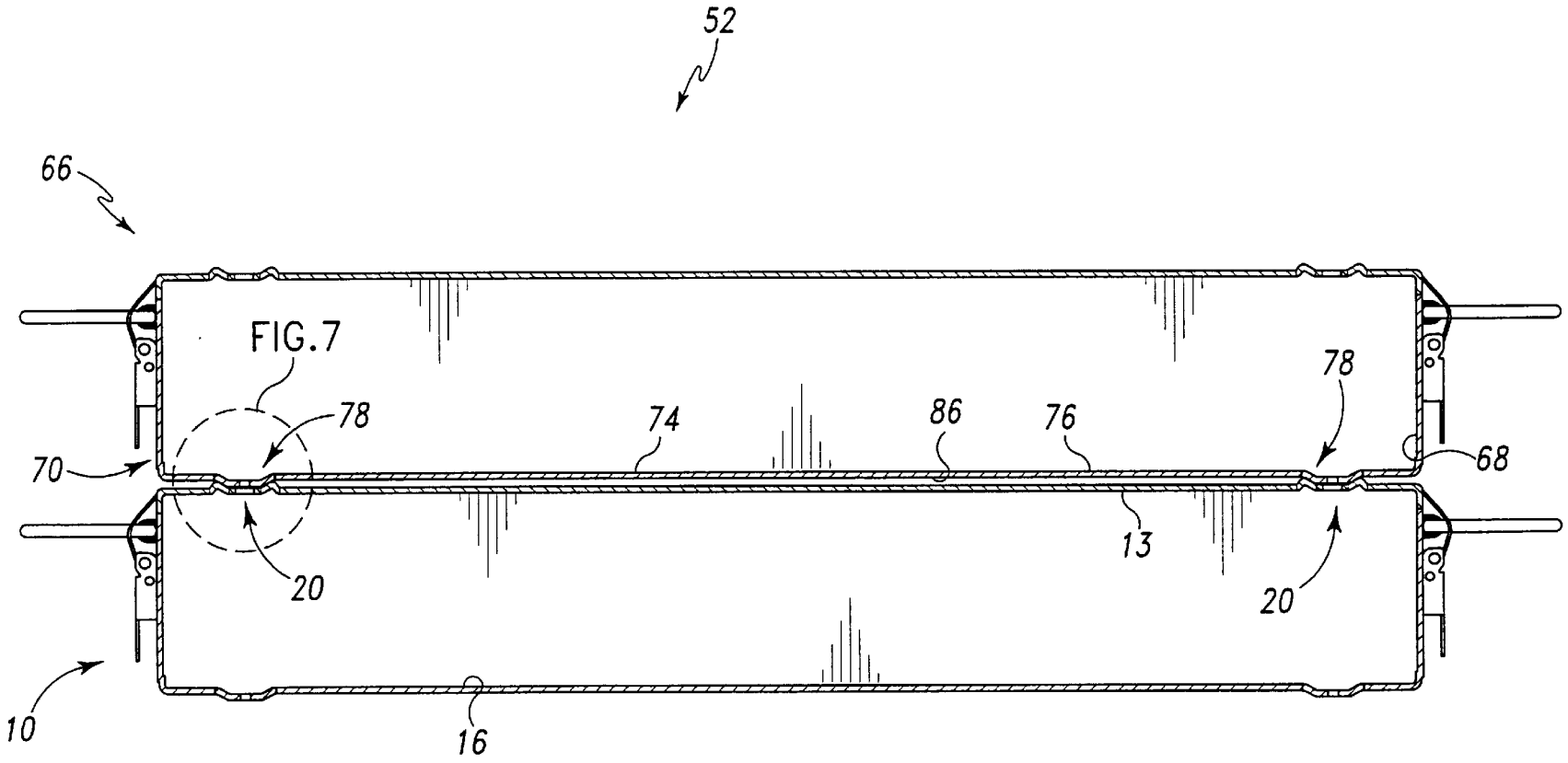
FIG. 6 is a cross sectional view of an instrument cassette assembly which incorporates the features of the present invention therein, with the instrument cassette assembly including the instrument cassette of FIG. 1 and another instrument cassette which is substantially identical to the instrument cassette of FIG. 1 stacked thereon.
Figure 7:
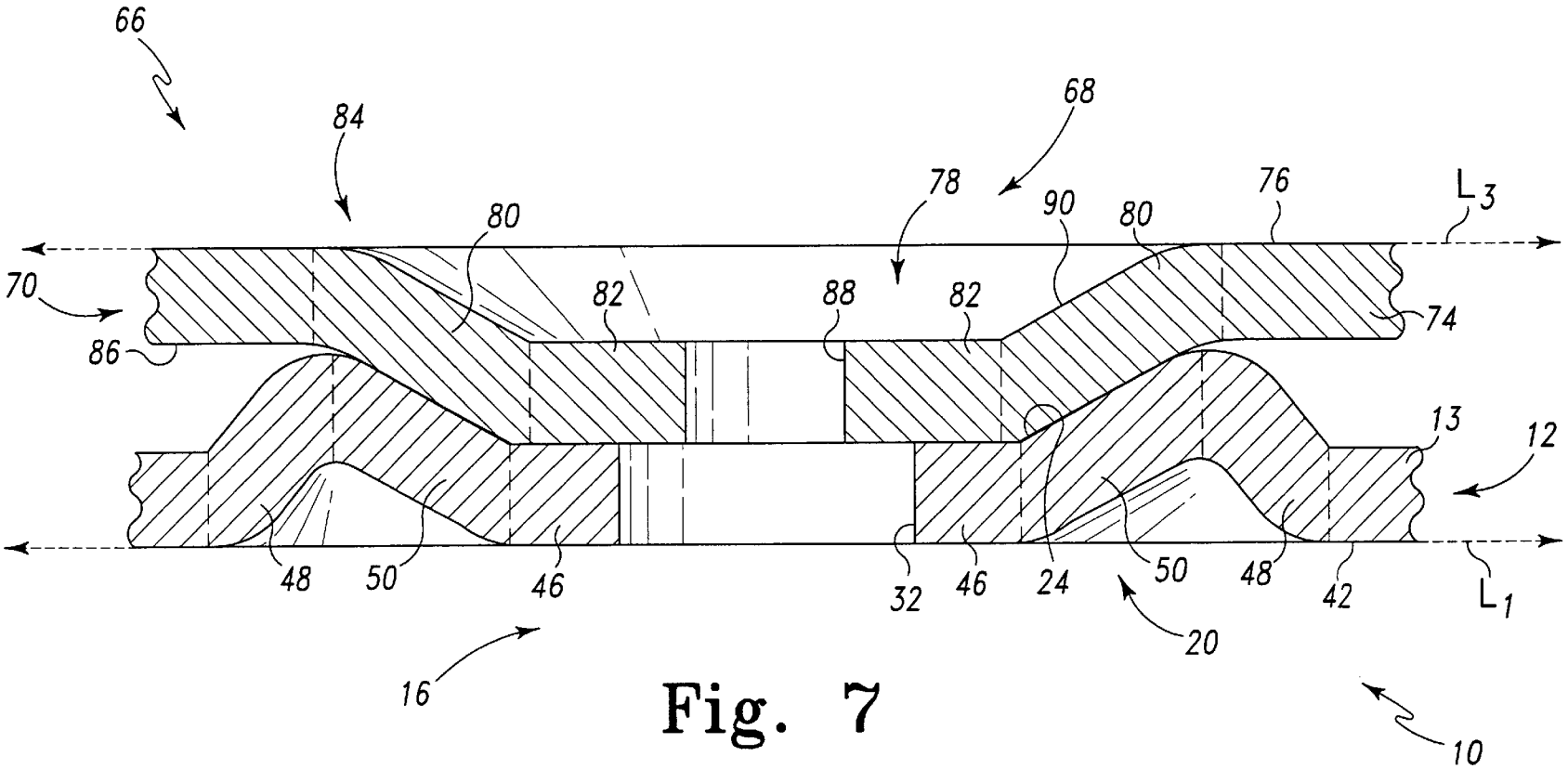
FIG. 7 is an enlarged view of the portion of FIG. 6 which is encircled and indicated as FIG. 7.

Referring now to FIG. 6, there is shown an instrument cassette assembly 52 of the present invention. Instrument cassette assembly 52 includes instrument cassette 10 and an instrument cassette 66 which is substantially identical to instrument cassette 10. In particular, instrument cassette 66 includes an interior space 68 and a container portion 70 having a plate 74 which defines a planar interior surface 76. In addition, a number of locating members 78 are formed in plate 74. It should be understood that locating members 78 are substantially identical to locating members 22 described above in reference to instrument cassette 10. Specifically, as shown in FIG. 7, each locating member 78 includes a locating segment 80 which extends immediately outwardly from planar interior surface 76 in a direction away from an interior surface line $L_3$ defined by planar interior surface 76. Locating member 78 also includes a locating segment 82 which (i) has a drainage hole 88 defined therein and (ii) extends from locating segment 80. Locating segment 80 and locating segment 82 collectively define a cassette leg 84 having a recess 90 defined therein. In addition, it should be understood that no portion of the cassette leg 84 extends into the interior space 68 across interior surface line $L_3$.

In FIGS. 6 and 7, instrument cassette 66 is shown positioned relative to instrument cassette 10 such that each cassette leg 84 is nested within pocket 24 of a respective positioning member 20. It should be understood that when cassette legs 84 and positioning members 20 are positioned in the above described manner, no portion of any cassette leg 84 extends across interior surface line $L_1$ into interior space 16 of instrument cassette 10. It should also be understood that when cassette legs 84 and positioning members 20 are positioned in the above described manner, no portion of any positioning member 20 extends across interior surface line $L_3$ into interior space 68 of instrument cassette 66. Since no portion of any cassette leg 84 extends into interior space 16, and no portion of any positioning member 20 extends into interior space 68, neither cassette leg 84 nor positioning member 20 consumes limited container space of either instrument cassette, 10, 66. In addition, since no portion of any cassette leg 84 extends into interior space 16, and no portion of any positioning member 20 extends into interior space 68, neither the cassette leg 84 nor the positioning member 20 creates an obstacle which could interfere with placement of instruments within the instrument cassettes 10, 66.

Furthermore, positioning instrument cassettes 10, 66 in the above described manner results in instrument cassette 66 being stacked on top of instrument cassette 10. It should be appreciated that nesting the cassette legs 84 of instrument cassette 10 within the pockets 24 of the positioning members 20 of instrument cassette 66 results in cassette 66 being inhibited from moving or sliding relative to instrument cassette 10. In addition, it should be appreciated that nesting the cassette legs 84 of instrument cassette 10 within the pockets 24 of the positioning members 20 of instrument cassette 66 results in a relatively wide air flow gap 86 being created between plate 74 of instrument cassette 66 and plate 13 of instrument cassette 10. The presence of air flow gap 86 between plate 74 and plate 13 is an important aspect of the present invention since it serves to enhance circulation of a sterilizing gas, such as steam, between adjacent stacked instrument cassettes 10, 66. Enhancing fluid circulation in the above described manner facilitates advancement of the sterilizing gas through the holes defined in instrument cassettes 10 and 66 (e.g. holes 28 and 29 defined in plate 13 and plate 36, respectively, of instrument cassette 10; see FIGS. 2 and 3). Such enhanced fluid circulation improves sterilization of the instruments contained within the instrument cassettes 10, 66.

The presence of air flow gap 86 between plate 74 and plate 13 also provides a space into which various structural elements (e.g. screws or other fastening mechanisms) can protrude out of instrument cassettes 10, 66 through the holes 28 defined in plate 13 and through holes (not shown) defined in plate 74. Having such a space prevents any of the protruding structural elements from contacting a surface of either instrument cassette 10 or 66 and thus disrupting the stacking arrangement thereof. In addition, air flow gap 86 prevents plate 74 and plate 13 from rubbing against each other and thus helps preserve any printed design (not shown) disposed thereon. Protecting such printed designs from wear and tear enhances the aesthetics of instrument cassettes 10, 66.

While the invention has been illustrated and described in detail in the drawings and foregoing description, such an illustration and description is to be considered as exemplary and not restrictive in character, it being understood that only the preferred embodiment has been shown and described and that all changes and modifications that come within the spirit of the invention are desired to be protected.

What is claimed is:

1. An instrument cassette, comprising:

a first container portion having a first plate which defines a first substantially planar interior surface, said first planar interior surface defining an interior surface line $L_1$;

a second container portion having a second plate which defines a second substantially planar interior surface, said second planar interior surface defining an interior surface line $L_2$, and said second container portion is positioned relative to said first container portion so that an interior space is defined therebetween;

a positioning member formed in said first plate, wherein (i) said positioning member includes a first positioning segment which extends immediately outwardly from said first planar interior surface in a direction away from said interior surface line $L_1$, (ii) said positioning member further includes a second positioning segment which extends inwardly from said first positioning segment in a direction toward said interior surface line $L_1$, and (iii) no portion of said first positioning segment or said second positioning segment extends into said interior space across said interior surface line $L_1$; and a locating member formed in said second plate, wherein (i) said locating member includes a first locating segment which extends immediately outwardly from said second planar interior surface in a direction away from said interior surface line $L_2$, (ii) a second locating segment which extends from said first locating segment, and (iii) no portion of said first locating segment or said second locating segment extends into said interior space across said interior surface line $L_2$;

wherein (i) said positioning member further includes a third positioning segment which extends from said second positioning segment, and (ii) no portion of said third positioning segment extends into said interior space across said interior surface line $L_1$;

wherein (i) said first locating segment and said second locating segment collectively define a cassette leg, (ii) said first positioning segment, said second positioning segment, and said third positioning segment collectively define a pocket for receiving said cassette leg therein, (iii) no portion of said cassette leg extends into said interior space across said interior surface line $L_2$, and (iv) no portion of said pocket extends into said interior space across said interior surface line $L_1$; and wherein said third positioning segment has a first drainage hole defined therein, whereby liquid entering said pocket may exit through said first drainage hole.

2. The instrument cassette of claim 1, wherein:

said cassette leg has a leg recess defined therein, and said second locating segment has a second drainage hole defined therein, whereby liquid entering said leg recess may exit through said second drainage hole.

3. An instrument cassette, comprising:

a lid having a cover plate which defines a first substantially planar interior surface, said first planar interior surface defining an interior surface line $L_1$;

a receptacle having a floor plate which defines a second substantially planar interior surface, said second planar interior surface defining an interior surface line $L_2$, and said receptacle is positioned relative to said lid so that an interior space is defined therebetween;

a positioning member formed in said cover plate, wherein (i) said positioning member includes a first positioning segment which extends immediately outwardly from said first planar interior surface in a direction away from said interior surface line $L_1$, (ii) said positioning member further includes a second positioning segment which extends inwardly from said first positioning segment in a direction toward said interior surface line $L_1$, and (iii) no portion of said first positioning segment or said second positioning segment extends into said interior space across said interior surface line $L_1$; and a locating member formed in said floor plate, wherein (i) said locating member includes a first locating segment which extends immediately outwardly from said second planar interior surface in a direction away from said interior surface line $L_2$, (ii) a second locating segment which extends from said first locating segment, and (iii) no portion of said first locating segment or said second locating segment extends into said interior space across said interior surface line $L_2$;

wherein (i) said positioning member further includes a third positioning segment which extends from said second positioning segment, and (ii) no portion of said third positioning segment extends into said interior space across said interior surface line $L_1$;

wherein (i) said first locating segment and said second locating segment collectively define a cassette leg, (ii) said first positioning segment, said second positioning segment, and said third positioning segment collectively define a pocket for receiving said cassette leg therein, (iii) no portion of said cassette leg extends into said interior space across said interior surface line $L_2$, and (iv) no portion of said pocket extends into said interior space across said interior surface line $L_1$; and wherein said third positioning segment has a first drainage hole defined therein, whereby liquid entering said pocket may exit through said first drainage hole.

4. The instrument cassette of claim 3, wherein:

said cassette leg has a leg recess defined therein, and said second locating segment has a second drainage hole defined therein, whereby liquid entering said leg recess may exit through said second drainage hole.

5. An instrument cassette assembly, comprising:

a first instrument cassette including (i) a first interior space, and (ii) a lid having a cover plate which defines a first substantially planar interior surface, said first planar interior surface defining an interior surface line $L_1$;

a positioning member formed in said cover plate, wherein (i) said positioning member includes a first positioning segment which extends immediately outwardly from said first planar interior surface in a direction away from said interior surface line $L_1$, (ii) said positioning member also includes a second positioning segment which extends inwardly from said first positioning segment in a direction toward said interior surface line $L_1$, (iii) said positioning member further includes a third positioning segment which extends from said second positioning segment, (iv) said first positioning segment, said second positioning segment, and said third positioning segment collectively define a pocket, and (v) no portion of said first positioning segment, said second positioning segment, or said third positioning segment extends into said interior space across said interior surface line $L_1$;

a second instrument cassette including (i) a second interior space, and (ii) a receptacle having a floor plate which defines a second substantially planar interior surface, said second planar interior surface defining an interior surface line $L_3$; and a locating member formed in said floor plate, wherein (i) said locating member includes a first locating segment which extends immediately outwardly from said second planar interior surface in a direction away from said interior surface line $L_3$, (ii) a second locating segment which extends from said first locating segment, (iii) said first locating segment and said second locating segment collectively define a cassette leg, (iv) no portion of said first locating segment or said second locating segment extends into said second interior space across said interior surface line $L_3$, (v) said second instrument cassette is positioned relative to said first instrument cassette such that (A) said cassette leg is located within said pocket and (B) an air flow gap is defined between said cover plate and said floor plate, and (vi) no portion of said cassette leg extends into said first interior space across said interior surface line $L_1$;

wherein said third positioning segment has a first drainage hole defined therein, whereby liquid entering said pocket may exit through said first drainage hole.

6. An instrument cassette assembly, comprising:

a first instrument cassette including (i) a first interior space, and (ii) a lid having a cover plate which defines a first substantially planar interior surface, said first planar interior surface defining an interior surface line $L_1$;

a positioning member formed in said cover plate, wherein (i) said positioning member includes a first positioning segment which extends immediately outwardly from said first planar interior surface in a direction away from said interior surface line $L_1$, (ii) said positioning member also includes a second positioning segment which extends inwardly from said first positioning segment in a direction toward said interior surface line $L_1$, (iii) said positioning member further includes a third positioning segment which extends from said second positioning segment, (iv) said first positioning segment, said second positioning segment, and said third positioning segment collectively define a pocket, and (v) no portion of said first positioning segment, said second positioning segment, or said third positioning segment extends into said interior space across said interior surface line $L_1$;

a second instrument cassette including (i) a second interior space, and (ii) a receptacle having a floor plate which defines a second substantially planar interior surface, said second planar interior surface defining an interior surface line $L_3$; and a locating member formed in said floor plate, wherein (i) said locating member includes a first locating segment which extends immediately outwardly from said second planar interior surface in a direction away from said interior surface line $L_3$, (ii) a second locating segment which extends from said first locating segment, (iii) said first locating segment and said second locating segment collectively define a cassette leg, (iv) no portion of said first locating segment or said second locating segment extends into said second interior space across said interior surface line $L_3$, (v) said second instrument cassette is positioned relative to said first instrument cassette such that (A) said cassette leg is located within said pocket and (B) an air flow gap is defined between said cover plate and said floor plate, and (vi) no portion of said cassette leg extends into said first interior space across said interior surface line $L_1$;

wherein said cassette leg has a leg recess defined therein; and wherein said second locating segment has a second drainage hole defined therein, whereby liquid entering said leg recess may exit through said second drainage hole.

* * * * *